United States Patent [19]

Dietrich

[11] Patent Number: 4,752,220

[45] Date of Patent: Jun. 21, 1988

[54] TARTAR REMOVER AND METHOD OF USE

[76] Inventor: Ursula B. Dietrich, 111 St. Matthews Ave., #9, San Mateo, Calif. 94401

[21] Appl. No.: 922,372

[22] Filed: Oct. 23, 1986

[51] Int. Cl.[4] ..... A61D 5/00

[52] U.S. Cl. ..... 433/1; 433/4; 433/143; 433/145; 433/159

[58] Field of Search ..... 433/1, 157, 159, 4, 433/141, 143, 160, 144, 145

[56] References Cited

U.S. PATENT DOCUMENTS

| | | | |
|---|---|---|---|
| 454,473 | 6/1891 | Haussmann | 433/1 |
| 502,386 | 8/1893 | Scheffer | 433/1 |
| 511,067 | 12/1893 | Walter | 433/1 |
| 553,718 | 1/1896 | Monfort | 433/144 |
| 575,750 | 1/1897 | Winkler | 433/143 |
| 617,587 | 1/1899 | Link | 433/159 |
| 833,375 | 10/1906 | Dollar | 433/145 |
| 879,537 | 2/1908 | Gartrell | 433/143 |
| 1,058,743 | 4/1913 | Gilbert | 433/145 |
| 1,220,933 | 3/1917 | Bates | 433/143 |
| 1,346,584 | 7/1920 | Angle | 433/4 |
| 1,730,230 | 10/1929 | Miller | 433/159 |
| 2,504,227 | 4/1950 | Rubba | 433/159 |
| 3,755,902 | 9/1973 | Northcutt | 433/4 |
| 4,600,381 | 7/1986 | Hodgson | 433/4 |

*Primary Examiner*—John J. Wilson

*Attorney, Agent, or Firm*—Townsend and Townsend

[57] ABSTRACT

A tartar remover, particularly useful for removing gross tartar deposits from the teeth of dogs and cats, includes first and second elongate members mounted to another at a central pivot. The elongate members include handles on one side of the pivot and jaws on the other side of the pivot. The first jaw tip has a transversely oriented cutting edge with sharp corners to engage the gross tartar deposits. The length of the second jaw, measured from the pivot to the tip of the jaw, is about 3 mm longer than the length of the first jaw. The tartar remover is used by first placing the inner surface of the second jaw against the tip of a tooth. The cutting edge of the first jaw is then positioned under the gross tartar deposit so that when the handles are squeezed, the tartar is cracked off the tooth.

4 Claims, 1 Drawing Sheet

TARTAR REMOVER AND METHOD OF USE

BACKGROUND OF THE INVENTION

Veterinarians are often required to remove tartar from the teeth of cats and dogs. The tartar often forms gross tartar deposits 2–3 mm thick. Presently these gross tartar deposits are removed in a very crude fashion using pliers or standard extraction forceps. Although these methods work to some extent, they are rather crude, time consuming and not totally acceptable.

SUMMARY OF THE INVENTION

The present invention is directed to a tartar remover which is particularly useful for removing gross tartar deposits from the teeth of dogs and cats. The tartar remover includes first and second elongate members mounted to another at a centrally located pivot. The elongate members include first and second handles on one side of the pivot and first and second jaws on the other side of the pivot. The tip of the first jaw has a transversely oriented cutting edge adapted to engage the gross tartar deposits. The length of the second jaw, measured from the pivot to the tip of the jaw, is about 3 mm longer than the length of the first jaw so that by placing the inner surface of the second jaw on the tip of a tooth, the cutting edge of the first jaw can be positioned to properly engage the gross tartar deposit. The cutting edge preferably terminates in sharp corners so that the user can engage the gross tartar deposits with either the cutting edge or the corners depending upon circumstances.

The present invention provides the user with a tool which is especially designed for removing gross tartar deposits in a convenient and efficient manner. The combination of the second jaw being longer than the the first jaw, so that the second jaw acts as a support or pivot against the tooth, with a cutting edge on the first jaw, for engaging and cracking off the gross tartar deposits, allows the user to effectively and efficiently remove gross tartar deposits from the teeth. The user need not be impeded by the necessarily cumbersome use of tools, such as pliers and extraction forceps, not intended for cleaning teeth.

Because of the difference in the lengths of the jaws, the force exerted by the cutting edge or one of the sharp corners is nearly parallel to the tooth surface. In contrast, with pliers or extraction forceps the tartar deposit engaging jaw presses laterally against the tooth to a greater extent than with the invention. Therefore, the tartar remover of the invention reduces the risk of damage to the tooth as well as increases the efficiency of operation compared with pliers and extraction forceps.

With the present invention the user can either engage the gross tartar deposit along the length of the cutting edge or, by manipulating the tartar remover, engage the tartar deposit with one of the sharp corners at the ends of the cutting edge. A tartar remover made according to the invention provides the user with a tool which is much more effective in removing gross tartar deposits than the make-shift tools used in the past.

Other features and advantages of the invention will appear from the following description in which the preferred embodiment has been set forth in detail in conjunction with the accompanying drawing.

DETAILED DESCRIPTION OF THE PREFERRED EMBODIMENT

Figure 1:
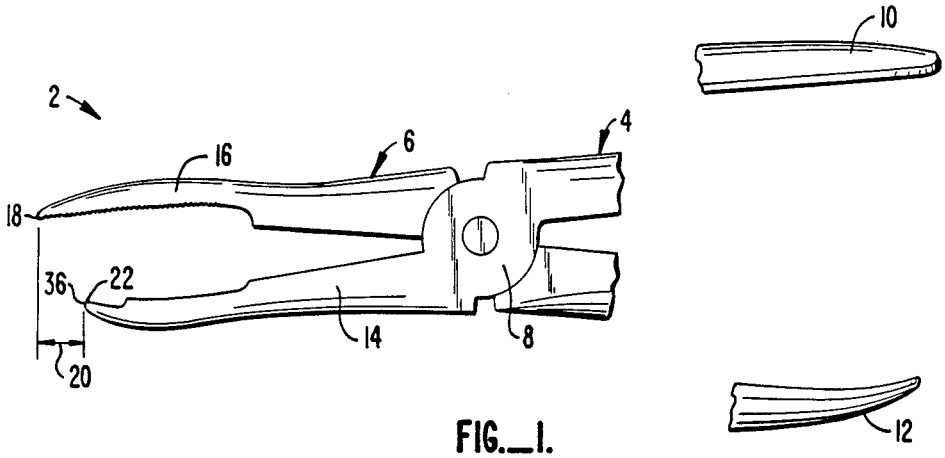
FIG. 1 is an overall view of a gross tartar remover made according to the invention.
Figure 4:
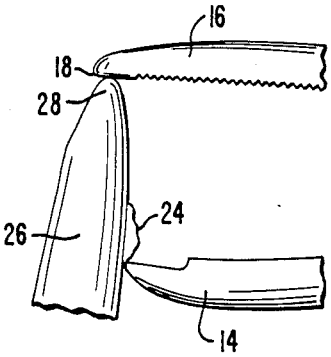
FIG. 4 is a side view of the gross tartar remover of FIG. 1 showing the first jaw engaging a gross tartar deposit and the second jaw engaging the tip of a tooth.

Referring now to FIG. 1, gross tartar remover 2 is shown to include the first and second elongate members 4, 6 pivotally secured to one another at a pivot 8. Members 4, 6 include first and second handles 10, 12 and first and second jaws 14, 16. The length of second jaw 16 from pivot 8 to its tip 18 is a distance 20 longer than the length of first jaw 14 between pivot 8 and its tip 22. As seen in FIG. 4, distance 20 enables first jaw 14 to conveniently engage a gross tartar deposit 24 on a tooth 26 with the second jaw 16 engaging the tip 28 of tooth 26. Distance 20 is about 3 mm in the preferred embodiment.

Figure 2B:
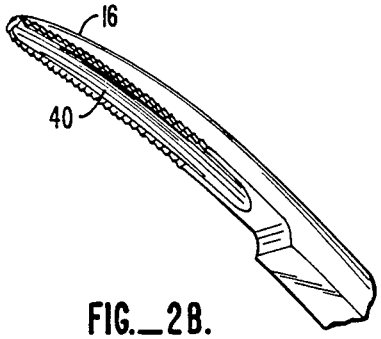
FIGS. 2A and 2B are perspective views of the tips of the first and second jaws.
Figure 3:
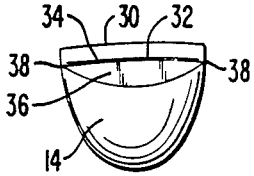
FIG. 3 is an end view of the first jaw showing the beveled surface.
Figure 2A:
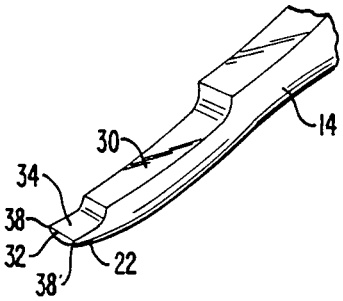

Turning now also to FIGS. 2A, 2B and 3, first jaw 14 is seen to include a stepped inner surface 30 with a transversely extending cutting edge 32 at tip 22. Cutting edge 32 is created by the intersection of a surface portion 34 of surface 30 and a beveled surface 36. The ends of cutting edge 32 define sharp corners 38. Second jaw 16 has a serrated, concave inner surface 40 which enables it to securely grip tip 28 of tooth 26 as shown in FIG. 4.

In use, the user positions surface 40 against tip 28 of tooth 26 so that second jaw 16 acts as a support or pivot for the movement of first jaw 14. Depending on the position and configuration of gross tartar deposit 24, either a sharp corner 38 or cutting edge 32 is positioned under and against deposit 24 and handles 10, 12 are squeezed forcing tip 22 of first jaw 14 against deposit 24 so to chip or break away the tartar deposit from the tooth. Because of the difference in lengths between the first and second jaws 14, 16, the user can properly engage both the tip 28 of tooth 26 and the gross tartar deposit 24 without the need to orient remover 2 at an awkward angle. Also, because of the difference in lengths, the force of tip 22 against tartar deposit 24 is directed generally parallel to or away from tooth 26. If jaws 14, 16 were the same length, the force would have been directed partially toward the tooth. The job of removing gross tartar deposits can thus proceed efficiently and quickly with a reduced chance of damaging the tooth compared with prior art methods. The remaining tartar can be removed using conventional tartar removing methods, such as ultrasonic techniques.

Modification and variation can be made to the disclosed embodiment without departing from the subject of the invention as defined in the following claims. Distance 20 may be varied according to the size of the teeth to be cleaned. Although cutting edge 32 is straight in the preferred embodiment, other shapes of edge 32 may work as well. Rather than a single pivot 8, gross tartar remover 2 could include more than one pivot point.

What is claimed is:

1. A veterinary gross tartar deposit remover for removing gross tartar deposits from a tooth of an animal comprising:

first and second members connected at a pivot point and including respective first and second handles on one side of the pivot point and first and second jaws on the other side of the pivot point, the second jaw being elongate;

the first jaw having a first tip and a first length measured from the pivot point to the first tip;

the second jaw having a second tip and a second length measured from the pivot point to the second tip, the second length being a chosen distance longer than the first length;

the first and second jaws having opposed first and second inner surfaces, the second inner surface being a roughened, elongate concave surface configured for engagement with the tip of the tooth;

the first tip having a cutting edge with sharp corners at each end for engaging a gross tartar deposit on the tooth, said cutting edge extending transversely with respect to the direction of movement of said jaws, so when the second inner surface engages the tip of the tooth, closing the first and second jaws breaks the gross tartar deposit away from the tooth.

2. The remover of claim 1 wherein the chosen distance is about 3 mm.

3. The remover of claim 1 wherein the cutting edge is beveled.

4. A method for removing gross tartar deposits from teeth of animals comprising the following steps:

selecting a tartar remover having first and second jaws, the first jaw having a cutting edge at a tip thereof, the cutting edge having sharp corners, the second jaw being elongate and having an elongate, concave inner surface;

placing the inner surface of the second jaw against the tip of a tooth;

positioning a sharp corner of the cutting edge of the first jaw against the gross tartar deposit, the first and second jaws pivotally connected to one another at a pivot point, the length of the second jaw, measured from the pivot point, being greater than the length of the first jaw; and moving the first jaw towards the second jaw so the cutting edge of the second jaw breaks the tartar deposit away from the tooth.

* * * * *